US007387498B2

(12) United States Patent
Schnetzka et al.

(10) Patent No.: US 7,387,498 B2
(45) Date of Patent: Jun. 17, 2008

(54) SYSTEM AND METHOD FOR NOISE ATTENUATION OF SCREW COMPRESSORS

(75) Inventors: Harold Robert Schnetzka, York, PA (US); E. Curtis Eichelberger, Jr., Harrisburg, PA (US); Paul Nemit, Jr., Roanoke, VA (US)

(73) Assignee: York International Corporation, York, PA (US)

( * ) Notice: Subject to any disclaimer, the term of this patent is extended or adjusted under 35 U.S.C. 154(b) by 688 days.

(21) Appl. No.: 10/728,157

(22) Filed: Dec. 4, 2003

(65) Prior Publication Data

US 2005/0123407 A1 Jun. 9, 2005

(51) Int. Cl.
*F04B 41/06* (2006.01)
*F04B 49/20* (2006.01)

(52) U.S. Cl. ..... 417/4; 417/22; 417/42; 417/53; 417/426

(58) Field of Classification Search ..... 417/2–5, 417/17, 22, 42, 312, 419, 53, 44.2, 426, 403, 417/429; 181/403
See application file for complete search history.

(56) References Cited

U.S. PATENT DOCUMENTS 3,936,606 A 2/1976 Wanke
4,151,725 A 5/1979 Kountz et al.
4,152,902 A 5/1979 Lush
4,384,462 A 5/1983 Overman et al.
4,580,947 A 4/1986 Shibata et al.
4,699,570 A * 10/1987 Bohn ..... 417/6
4,810,168 A * 3/1989 Nogami et al. ..... 417/2
5,107,685 A 4/1992 Kobayashi
5,117,642 A 6/1992 Nakanishi et al.
5,253,486 A 10/1993 Sugahara et al.
5,343,384 A 8/1994 Fisher et al.
5,492,273 A 2/1996 Shah
5,499,301 A 3/1996 Sudo et al.
5,502,770 A 3/1996 Kuo et al.
5,596,879 A * 1/1997 Burkhart et al. ..... 62/296
5,662,136 A 9/1997 Drzewiecki et al.
5,769,314 A 6/1998 Drees et al.
5,771,704 A 6/1998 Nakajima et al.

(Continued)

FOREIGN PATENT DOCUMENTS

JP 58018046 2/1983

(Continued)

*Primary Examiner*—Charles G Freay
(74) *Attorney, Agent, or Firm*—McNees Wallace & Nurick LLC

(57) ABSTRACT

A system is provided for attenuating noise in at least two positive displacement compressors proximately located from each other for use with at least one heating or cooling system. A lead compressor and a lag compressor have a selectably controllable rotational speed and a selectably controllable phase of operation. A controller selectably controls the rotational speed and the phase of operation of each of the compressors. The controller controls the rotational speed of the compressors at a predetermined rotational speed that is substantially the same for each of the compressors. The controller controls the phase of operation of the compressors by shifting the phase of operation of the lag compressor so that an outlet pressure pulse operatively produced by the lag compressor is substantially evenly spaced between successive outlet pressure pulses operatively produced by the reference compressor.

8 Claims, 2 Drawing Sheets

U.S. PATENT DOCUMENTS 5,797,729 A * 8/1998 Rafuse et al. ..... 417/3
5,845,509 A 12/1998 Shaw et al.
5,950,439 A * 9/1999 Peterson et al. ..... 62/80
6,065,298 A 5/2000 Fujimoto
2004/0126243 A1* 7/2004 Sievert et al. ..... 417/44.2

FOREIGN PATENT DOCUMENTS

JP 61190233 A 8/1986

* cited by examiner

SYSTEM AND METHOD FOR NOISE ATTENUATION OF SCREW COMPRESSORS

BACKGROUND OF THE INVENTION

The present invention relates generally to a method of operation and apparatus for noise attenuation of positive displacement compressors, and more particularly, to a method of operation and apparatus for noise attenuation of screw compressors that decreases the composite pressure pulse of the screw compressors by varying the speed of one or more of the screw compressors.

Heating and cooling systems typically maintain temperature control in a structure by circulating a fluid within coiled tubes such that passing another fluid over the tubes effects a transfer of thermal energy between the two fluids. A primary component in such a system is a positive displacement compressor which receives a cool, low pressure gas and by virtue of a compression device, exhausts a hot, high gas. One type of positive displacement compressor is a screw compressor, which generally includes two cylindrical rotors mounted on separate shafts inside a hollow, double-barreled casing. The side-walls of the compressor casing typically form two parallel, overlapping cylinders which house the rotors side-by-side, with their shafts parallel to the ground. Screw compressor rotors typically have helically extending lobes and grooves on their outer surfaces forming a large thread on the circumference of the rotor. During operation, the threads of the rotors mesh together, with the lobes on one rotor meshing with the corresponding grooves on the other rotor to form a series of gaps between the rotors. These gaps form a continuous compression chamber that communicates with the compressor inlet opening, or "port," at one end of the casing and continuously reduces in volume as the rotors turn and compress the gas toward a discharge port at the opposite end of the casing for use in the system.

These rotors rotate at high rates of speed, and multiple sets of rotors (compressors) may be configured to work together to further increase the amount of gas that can be circulated in the system, thereby increasing the operating capacity of a system. While the rotors provide a continuous pumping action, each set of rotors (compressor) produces pressure pulses as the pressurized fluid is discharged at the discharge port. These discharge pressure pulsations act as significant sources of audible sound within the system. In addition, when multiple rotors (compressors) are proximately located, whether being utilized within the same or independent heating or cooling systems, if the rotors are not operating at substantially the same rotational speed, a phenomenon known as beating may occur. Beating, also referred to as beats, result from a difference between the frequencies of the discharge pressure pulsations. In addition to providing further undesirable sound, beats can potentially damage the compressors.

To eliminate or minimize beats and the undesirable sound, noise attenuation devices or systems can be used. One example of a noise attenuation system is a dissipative or absorptive muffler system typically located at the discharge of the compressors. The use of muffler systems to attenuate sound can be expensive, depending upon the frequencies that must be attenuated by the muffler system. Typically, the lower the frequency of the sound to be attenuated, the greater the cost and size of the muffler system.

What is needed is a cost-effective, efficient and easily implemented method or apparatus for compressor noise attenuation that may be used with multiple variable speed compressors.

SUMMARY OF THE INVENTION

The present invention relates to a method for attenuating noise in at least two positive displacement compressors proximately located from each other having a reference compressor for providing reference operational settings for comparison with the remaining compressors. The steps include providing at least two compressors including a reference compressor, the compressors having a selectably controllable rotational speed and a selectably controllable phase of operation; providing a controller for selectably controlling the rotational speed and the phase of operation of each of the compressors; providing a sensor for sensing the rotational speed and the phase of operation of each of the compressors; controlling the rotational speed of the compressors at a predetermined rotational speed that is substantially the same for each of the compressors; and controlling the phase of operation of the compressors wherein the phase of operation of the remaining of the compressors, not including the reference compressor, is shifted so that an outlet pressure pulse operatively produced by each of the remaining compressors is substantially evenly spaced between successive outlet pressure pulses operatively produced by the reference compressor. Note: A three-compressor system would interleave the two remaining compressors' discharge pulsations evenly between the reference compressor's discharge pressure pulsations, effectively tripling the pressure pulsation fundamental frequency. A four-compressor system would quadruple the pressure pulsations etc. Alternatively, a pair of two-compressor systems could operate independently from one another in regards to speed, if so desired.

The present invention further relates to a system for attenuating noise in at least two positive displacement compressors proximately located from each other, which includes a reference compressor. The compressors have a selectably controllable rotational speed and a selectably controllable phase of operation. A means of control selectably controls the rotational speed and the phase of operation of each of the compressors. A sensing means senses the rotational speed and the phase of operation of each of the compressors. The means of control controls the rotational speed of the compressors at a predetermined rotational speed that is substantially the same for each of the compressors. The means of control controls the phase of operation of the compressors by shifting the phase of operation of all the compressors with the exception of the reference compressor. The phase of operation of the remaining compressors other than the reference compressor is shifted so that an outlet pressure pulse operatively produced by each of the remaining compressors is substantially evenly spaced between successive outlet pressure pulses operatively produced by the reference compressor.

An advantage of the present invention is the reduction in the size and cost of dissipative or attenuating muffler systems.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
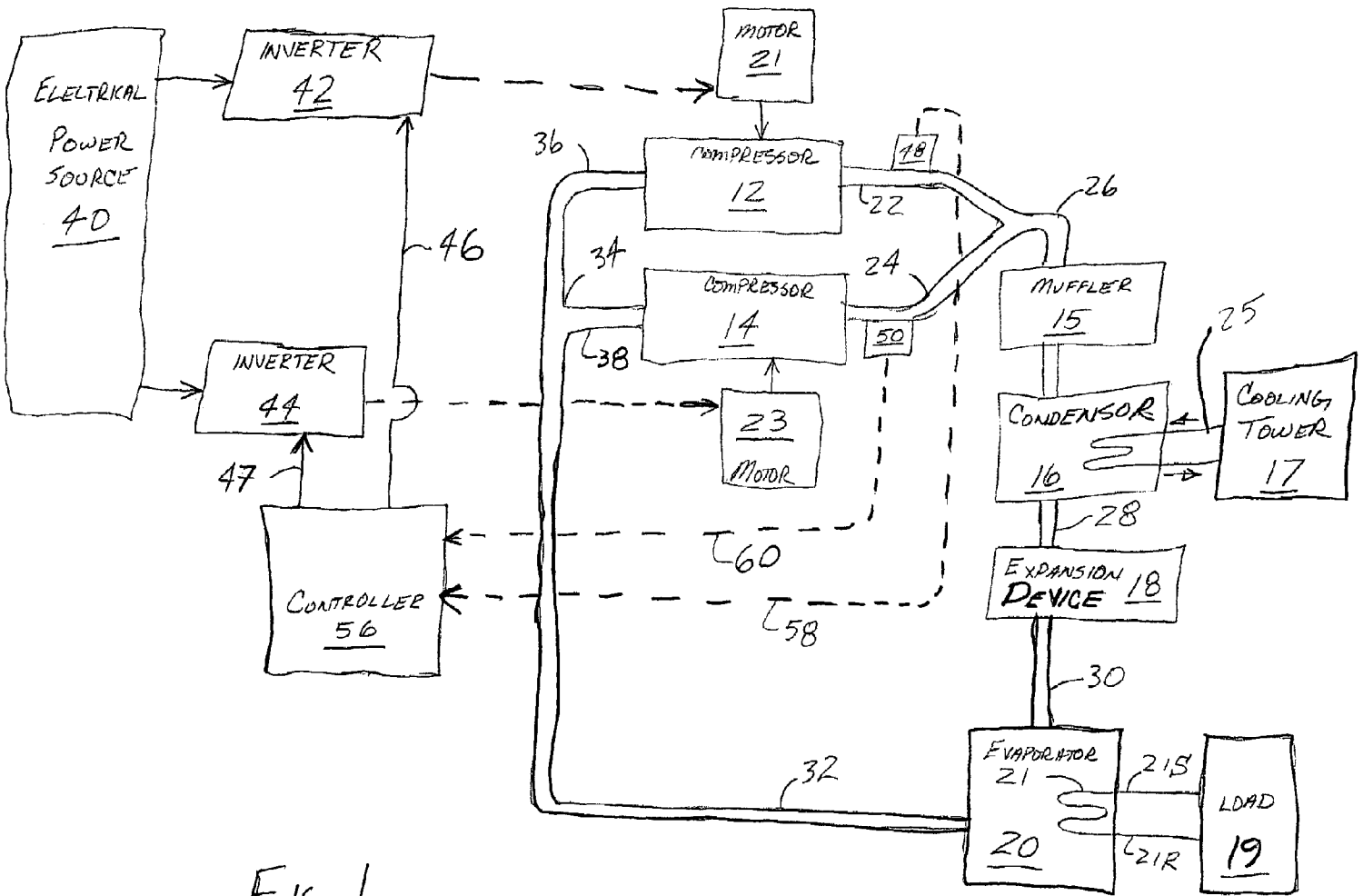
FIG. 1 is a schematic of a continuously variable speed compressor system of the present invention.

One embodiment of the heating, ventilation, air conditioning or refrigeration (HVAC&R) system 10 of the present invention is depicted in FIG. 1. A positive displacement lead compressor 12 is connected to a motor 21 and inverter 42, for selectively controlling operational parameters, such as rotational speed, of the compressor 12. Compressor 12 discharges compressed refrigerant gas through discharge line 22. Similarly, compressor 14, which operates in parallel with compressor 12, discharges compressed refrigerant gas through discharge line 24. These compressors are typically positive displacement compressors, such as screw, reciprocating or scroll, having a wide range of cooling capacity. Sensors 48, 50 monitor refrigerant gas parameters, such as pressure pulses, passing through respective discharge lines 22, 24 providing parameter inputs to a controller 56 via respective lines 58, 60. The controller 56 includes logic devices, such as a microprocessor or other electronic means, for the generation of speed control signals 47 and 48 for controlling the operating parameters of compressors 12, 14 by controlling their respective inverters 42, 44 and motors 21, 23. AC electrical power received from an electrical power source 40 is rectified from AC to DC, and then inverted from DC back to variable frequency AC by inverters 42, 44 for driving respective compressor motors 21, 23. The compressor motors are typically AC induction, but might also be Brushless Permanent Magnet or Switched Reluctance motors. After refrigerant gas that is compressed by compressors 12, 14 is directed downstream of sensors 48, 50, discharge lines 22, 24 join and become a common line 26, although lines 22, 24 may remain separate if desired. Optionally, muffler 15 is positioned along the common line 26 to dissipate or absorb the pressure pulses generated by operation of the compressors 12, 14.

Common line 26 delivers refrigerant gas to the condenser 16, which enters into a heat exchange relationship with a fluid, preferably water, flowing through a heat-exchanger coil 25 connected to a cooling tower 17. The refrigerant vapor in the condenser 16 undergoes a phase change to a refrigerant liquid as a result of the heat exchange relationship with the liquid in the heat-exchanger coil 25. The condensed liquid refrigerant from condenser 16 flows along a conduit 28 to an expansion device 18, which greatly lowers the temperature and pressure of the refrigerant before entering the evaporator 20 via conduit 30. Alternately, the condenser can reject the heat directly into the atmosphere through the use of air movement across a series of finned surfaces (direct expansion condenser).

The evaporator 20 can include a heat-exchanger coil 21 having a supply line 21S and a return line 21R connected to a cooling load 19. The heat-exchanger coil 21 can include a plurality of tube bundles within the evaporator 20. Water or any other suitable secondary refrigerant, e.g., ethylene, calcium chloride brine or sodium chloride brine, travels into the evaporator 20 via return line 21R and exits the evaporator 20 via supply line 21S. The liquid refrigerant in the evaporator 20 enters into a heat exchange relationship with the water in the heat-exchanger coil 21 to chill the temperature of the water in the heat-exchanger coil 21. The refrigerant liquid in the evaporator 20 undergoes a phase change to a refrigerant gas as a result of the heat exchange relationship with the liquid in the heat-exchanger coil 21. The gas refrigerant in the evaporator 20 then returns to the compressors 12, 14 by suction line 32 which bifurcates at suction plenum 34 to separate suction lines 36, 38 which join respective compressors 12, 14 to complete the cycle. In another embodiment of the present invention, the suction line 32 from the evaporator 20 to the compressors 12, 14 can be continuously separate lines that deliver refrigerant gas to the compressors 12, 14.

Inverters 42, 43 collectively provide variable speed control to the operating parameters of respective compressors 12, 14 by independently controlling both the frequency and voltage magnitude of electrical power to the motors 21, 23 by power source 40. Collectively, inverters 42, 43 can simultaneously vary both the frequency and voltage, as dictated by the controller 56 via respective speed control signals 46, 47 to provide control of the overall system refrigeration capacity through the use of variable speed modulation of compressors 12, 14. Inverters 42, 44 are also referred to in the industry as variable speed or variable frequency drives. Alternately, variable speed drives 42, 44 may contain a single AC to DC converter and two or more DC to AC inverts to provide a lower cost solution. While the system of the present invention illustrates two variable speed drives for selectively controlling two compressors, so long as each compressor is controlled by a separately designated variable speed drive, it is envisioned that any number of compressors may be employed.

Inverter 42 controls the operating parameters applied to the motor of lead compressor 12 via speed control signal 46. The remaining compressors in the system are referred to as lag compressors. Selection of lead compressor 12 is not critical as it is not dependent on size, but is for identifying an operating point of reference for the controller 56. Thus, the compressors used in system 10 are not required to be of the same capacity.

Controller 56, which controls the operations of system 10, employs continuous feedback from sensors 48, 50 to continuously monitor and change the frequency and voltage applied to compressors 12, 14 in response to changes in system cooling loads. That is, as the system 10 requires either additional or reduced cooling capacity, which is constantly monitored by the controller 56, the operating parameters of any of the compressors 12, 14 in the system 10 may likewise be revised. To maintain maximum operating efficiency, the operating frequencies of the compressors 12, 14 are changing constantly, such as proportionally changing the operating frequencies of all the compressors, or any compressors, as controlled by a capacity control algorithm within the controller 56. However, separate from system load requirements, the controller 56 also continuously monitors the gas parameter readings provided by sensors 48, 50 to minimize the resultant compressor sound level in the system.

Figure 2:
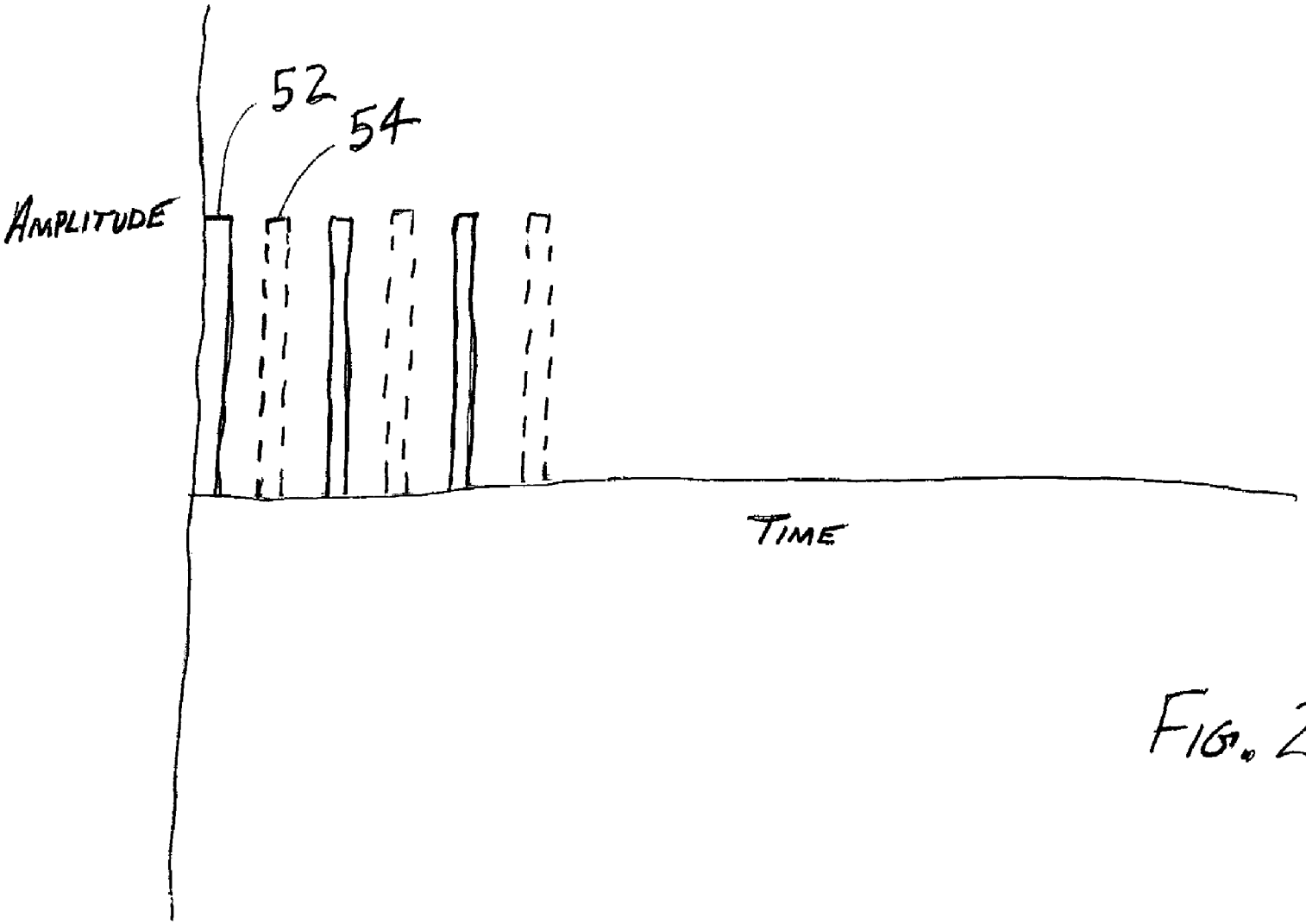
FIG. 2 is a diagram of compressor pressure pulses shifted by the method of the present invention.

One way for the controller 56 to effect noise attenuation in system 10 is to control the phase of operation of the compressor 14 with respect to compressor 12. The controller 56 monitors the occurrence of pressure pulses from the lead or reference compressor 12 by use of sensor 48. From this information, the controller 56 varies the magnitude of speed control signal 47 which is applied to inverter 44 to synchronize the feedback pressure pulses emanating from the lag compressor 14 via sensor 50 with respect to frequency and simultaneously interleave the pulsations with respect to the phase of the pressure pulsations sensed by sensor 48. Referring to FIG. 2, which depicts the pressure pulses as square waves, wave 52 corresponding to lead compressor 12 pressure pulses and wave 54 corresponding to lag compressor 14 pressure pulses. Preferably, the phase of wave 54 is shifted such that the pulse of wave 54 is positioned substantially equidistant between successive pulses of wave 52. This shifting preferably produces a resultant or effective output wave that is twice the frequency of wave 52 having a wavelength half that of wave 52. Higher frequency waves are easier to attenuate, requiring smaller, less expensive dissipating or absorption mufflers.

In an alternate embodiment, additional lag compressors may be employed. By placing additional lag compressor waves in the system which are substantially equally spaced between successive pulses of the lead compressor, the resultant wave frequency is multiplied by the total number of compressors. Preferably, two to four compressors are employed in this arrangement. Therefore, if there are four compressors, whose pulse pattern is shifted in accordance with the present invention, the resultant pulse wave frequency is multiplied by four, although any number of compressors may be used in a system.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for attenuating noise in at least one heating or cooling system, comprising:

providing at least two compressors selectably controlling the rotational speed and the phase of operation of each compressor of the at least two compressors;

sensing outlet pressure pulses associated with each compressor of the at least two compressors;

determining the rotational speed and the phase of operation of each compressor of the at least two compressors based on the sensed outlet pressure pulses;

controlling the rotational speed of the at least two compressors at a predetermined rotational speed that is substantially the same for each compressor of the at least two compressors; and shifting the phase of operation of at least one compressor of the at least two compressors so that outlet pressure pulses operatively produced by the at least two compressors are substantially evenly spaced.

2. The method of claim 1 wherein the step of shifting the phase of operation is performed in order to produce a composite pressure pulse frequency higher than the frequency of each compressor.

3. The method of claim 1 wherein the step of shifting the phase of operation is performed in order to produce a composite pressure pulse frequency that is a factor of "n" times higher than the frequency of each compressor, "n" being a total number of the at least two compressors.

4. The method of claim 1 wherein in the at least two compressors are screw compressors.

5. A system for attenuating noise in at least one heating or cooling system comprising:

at least two compressors;

a means of control for selectably controlling the rotational speed and the phase of operation of each compressor of the at least two compressors;

a sensing means for sensing outlet pressure pulses associated with each compressor of the at least two compressors;

the means of control configured to determine the rotational speed and the phase of operation of each compressor of the at least two compressors based on the sensed outlet pressure pulses, and to control:

the rotational speed of the at least two compressors at a predetermined rotational speed that is substantially the same and the phase of operation of the at least two compressors so that outlet pressure pulses operatively produced by the at least two compressors are substantially evenly spaced.

6. The system of claim 5 wherein the means of control is a variable speed drive.

7. The system of claim 5 wherein the means of control for each compressor of the at least two compressors is a variable speed drive.

8. A method for attenuating noise in at least one heating or cooling system, comprising:

providing at least two compressors;

selectably controlling the rotational speed and the phase of operation of each compressor of the at least two compressors;

sensing outlet pressure pulses associated with each compressor;

determining the rotational speed and the phase of operation of each compressor of the at least two compressors based on the sensed outlet pressure pulses;

controlling by the means of control the rotational speed of the at least two compressors at a predetermined rotational speed that is substantially the same for each compressor of the at least two compressors; and shifting the phase of operation of at least one compressor of the at least two compressors so that outlet pressure pulses operatively produced by each compressor of the at least two compressors are substantially evenly spaced;

wherein the composite pressure pulse frequency is a factor of "n" times higher than the frequency between successive outlet pulses of each compressor, "n" being a total number of the at least two compressors.

* * * * *